United States Patent [19]

Hegarty

[11] Patent Number: 4,787,595

[45] Date of Patent: Nov. 29, 1988

[54] MULTI-POSITIONABLE DOCUMENT SUPPORT STAND AND INTERLOCKING MODULAR DOCUMENT HOLDER

[76] Inventor: David Hegarty, 36 Wyatt Rd., Garden City, N.Y. 11530

[21] Appl. No.: 45,630

[22] Filed: May 1, 1987

Related U.S. Application Data

[63] Continuation-in-part of Ser. No. 791,743, Oct. 28, 1985, abandoned.

[51] Int. Cl.[4] ..... A47G 1/24

[52] U.S. Cl. ..... 248/454; 248/447; 248/458

[58] Field of Search ..... 248/454, 455, 458, 456, 248/447, 450, 451, 452, 453, 295.1, 296, 298, 447.2; 402/75, 73, 70; 403/381, 375, 354, 331

[56] References Cited

U.S. PATENT DOCUMENTS

| | | | |
|---|---|---|---|
| 598,689 | 2/1898 | Wilson | 248/454 |
| 2,003,746 | 6/1935 | Headington | 248/456 X |
| 2,165,255 | 7/1939 | Hamilton | 248/455 |
| 2,325,155 | 7/1943 | Wedge | 402/75 |
| 2,459,873 | 1/1949 | Curtis | 248/454 |
| 2,502,275 | 3/1950 | Perlin | 150/1.6 |
| 2,562,518 | 7/1951 | Abrams | 281/19 |
| 2,568,131 | 9/1951 | Segal | 281/29 |
| 2,620,801 | 12/1952 | Panfil | 129/1 |
| 2,721,417 | 10/1955 | Dickinson | 248/453 |
| 3,043,047 | 7/1962 | La Fleur | 248/454 |
| 3,095,665 | 7/1963 | Killen | 248/452 X |
| 3,366,359 | 1/1968 | Wolf et al. | 248/447 |
| 3,408,032 | 10/1968 | Francis | 248/454 X |
| 4,116,413 | 9/1978 | Andersen | 248/455 X |
| 4,179,091 | 12/1979 | Bidney | 248/295.1 X |
| 4,389,133 | 6/1983 | Oberst | 403/407.1 X |
| 4,444,418 | 4/1984 | Goldstein | 281/45 |
| 4,508,306 | 4/1985 | Kemmerer | 248/454 |
| 4,564,732 | 1/1986 | Lancaster et al. | 403/381 X |
| 4,568,052 | 2/1986 | Solomon et al. | 248/447 X |
| 4,582,442 | 4/1986 | Rager | 402/75 |
| 4,583,877 | 4/1986 | Wilson | 402/75 |

FOREIGN PATENT DOCUMENTS

| | | | |
|---|---|---|---|
| 2659818 | 10/1977 | Fed. Rep. of Germany | 248/295.1 |

OTHER PUBLICATIONS

Desk Literature Rack (Date Unknown).

*Primary Examiner*—Ramon O. Ramirez
*Attorney, Agent, or Firm*—Hoffmann & Baron

[57] ABSTRACT

A document support stand for removably mounting a document holder on the stand includes a main body which may be formed in the shape of a truncated pyramid. The body has a viewing side, and first and second support sides for supporting the stand on a desk or table top. The support sides constitute adjacent sides on the truncated pyramid body, and are disposed at acute angles to the viewing side. An elongated bracket defining a T-slot is mounted on the viewing side of the body. The document holder includes an elongated member configured as a T-shaped rail which is receivable by the bracket of the stand so that the document holder may be mounted on the stand. The stand may be rotated 90° from one support side to the other so that the viewing side and the document holder mounted on the viewing side may be disposed in different viewing positions.

31 Claims, 6 Drawing Sheets

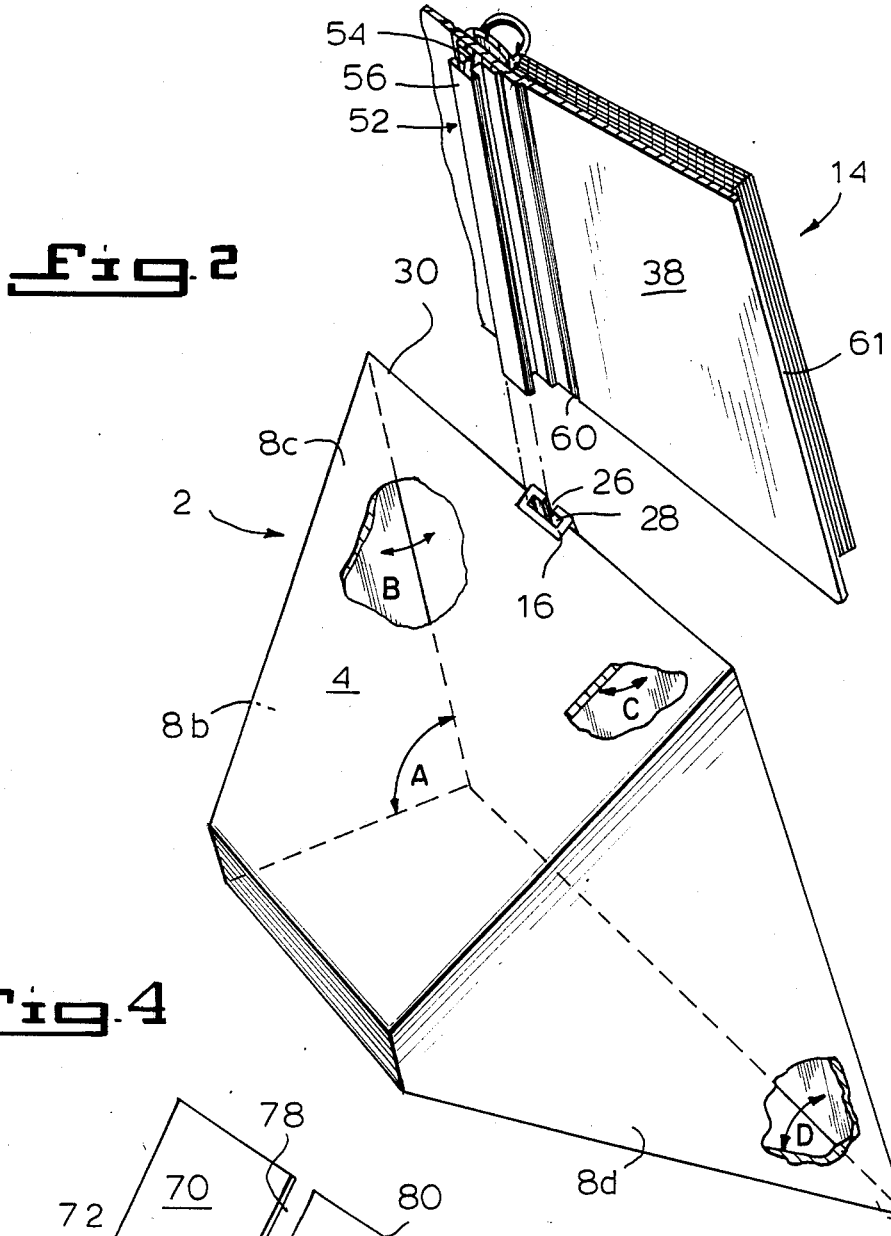
Fig. 2
Fig. 4
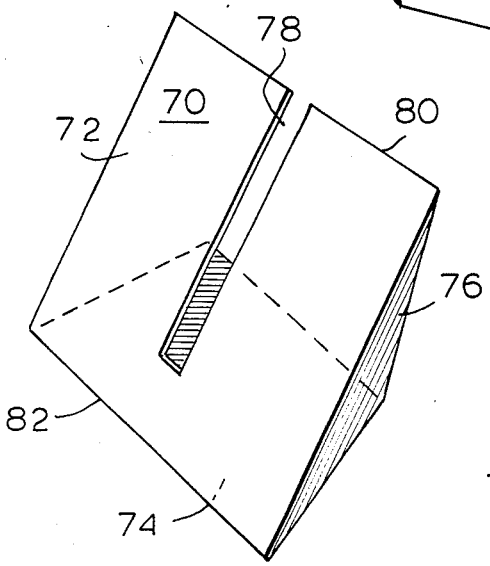
Fig. 4A
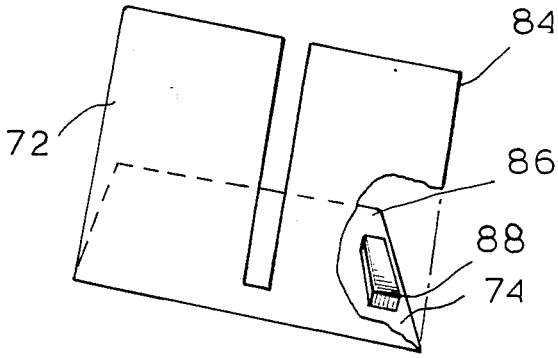

Fig. 11
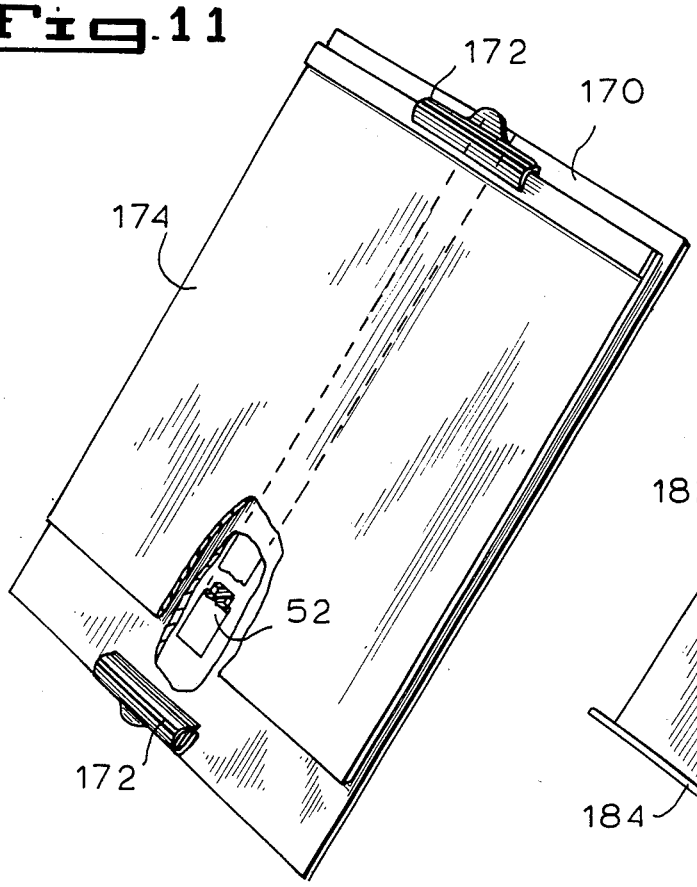
Fig. 13
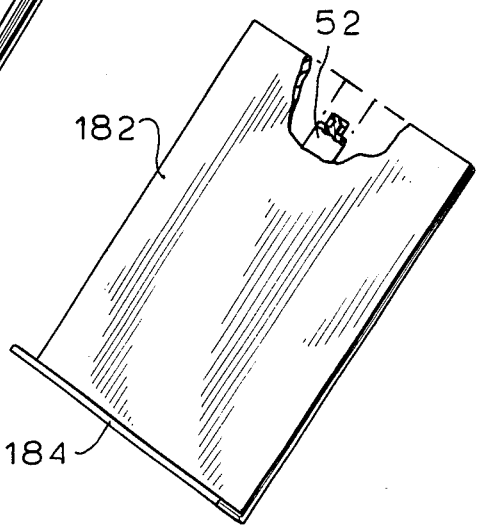
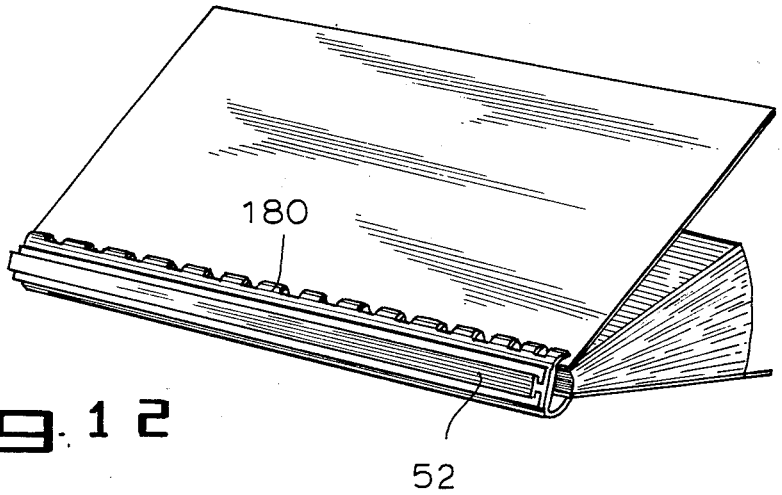
Fig. 12

MULTI-POSITIONABLE DOCUMENT SUPPORT STAND AND INTERLOCKING MODULAR DOCUMENT HOLDER

CROSS-REFERENCE TO RELATED APPLICATION

This application is a continuation-in-part of co-pending prior application Ser. No. 791,743, filed Oct. 28, 1985, now abandoned.

BACKGROUND OF THE INVENTION

1. Field of the Invention

This invention relates to document support devices, and more particularly relates to a desk top supported or suspended stand for supporting documents in two or more viewing dispositions, and document holders which can be selectively interlocked with the support stand.

2. Description of the Prior Art

The term "document" hereinafter refers to a single page or a multiple number of pages.

The term "document holder" hereinafter refers to that type of device which is adapted to secure a document, such as in the form of a book, spiral bound manual, loose-leaf binder or the like, as well as conventional document stands, such as will be described, which are modified in accordance with the principles of this invention.

Document support stands for supporting a document or document holder are well-known in the art and come in a variety of configurations and structures. Many conventional stands are designed to rest on a desk or table top, and to support the document at a substantial viewing angle to the horizontal. This lessens eye fatigue and strain which normally results from viewing a document which rests on a horizontal structure.

One of the primary disadvantages of many conventional viewing stands is that they are not adaptable for supporting a document in multiple viewing positions without manipulating the document on the stand.

For example, one conventional type of document support stand is L-shaped and includes an easel back with a bottom support ledge on which the document or document holder rests. This easel type stand is designed primarily to support a book, spiral bound manual, loose-leaf binder or other form of document holder with its spine in a vertical disposition, the edge of the spine being supported by the ledge of the stand. The stand is not designed to support the document holder on the side edge of the holder's back cover with its spine horizontal, nor is the document holder designed to be supported in such a manner, as the document holder supported thusly oftentimes folds uncontrollably at creases formed in its cover, collapses under its weight or generally can not be maintained upright and open on the stand.

Certain other types of conventional viewing stands include a document securing bar, page retainer or sentence marker which extends across the viewing surface of the stand. Many times the securing bar is suitable to hold a manual or loose-leaf binder against its viewing surface with the spine of the manual or binder in a horizontal disposition, especially if the manual or binder is lightweight and not bulky.

However, changing the reading pattern requires removing the securing bar and manipulating the manual on the stand, and then readjusting the securing bar to support the manual in its new disposition. Furthermore, the securing bar itself may interfere with the material being read, and it may be necessary to constantly readjust the position of the securing bar.

Another type of conventional stand is the clipboard type, having a support back and a clip fastener mounted on the support back. Like other conventional document support stands, manipulation of the document on the stand is required to change the reading pattern. Furthermore, this type of stand is impractical in use because it requires refastening the document each time a page is turned. Also, the clip fastener may be undersized to support a bulky manual.

The problem of having to change the reading pattern is exacerbated in today's society where many of the manuals digested are of a technical nature and include diagrams and charts in columnar form. This is particularly true with present day computer software documentation and training manuals in which text is presented in a standard book format, with pages turning from left to right and computer screen illustrations, flow charts, programs and tables being presented from top to bottom. The reader must constantly adjust his reading pattern by manipulating the manual. This constant need for reorientation by the computer operator trainee is inefficient, confusing and tiring, all of which impairs the learning process.

The further problem with document support stands which are currently available is that they are not adapted to adequately support the newer forms of loose-leaf binders. These binders are often of the type which use a loose-leaf D ring mechanism, with the mechanism being offset from the center spine panel of the cover or jacket and being mounted on the inside back cover of the binder. Offsetting the ring mechanism is advantageous for storing pages uniformly and compactly. However, such offsetting requires that the cover or jacket of the binder be made considerably larger than a conventional binder cover. The large cover consumes valuable desk top space, and the binders are cumbersome and poorly supported on the side edges of their cover by conventional viewing stands.

No currently available viewing stand has the ability to rotatably support a binder mechanism of a loose-leaf binder, which mechanism may be removed from the cover or jacket of the loose-leaf binder and directly secured to the viewing stand, without the jacket.

Furthermore, the viewing stands which are currently available have their own supporting mechanism, such as a bracket mounted on the back of the viewing stand to support the stand in a particular angular disposition for viewing documents. No common support mechanism is currently available which is adapted to interfit with and support various types of document support stands so that different stands may be interchanged on the same supporting mechanism.

OBJECTS AND SUMMARY OF THE INVENTION

It is an object of the present invention to provide a document support stand adapted for securing a document holder in multiple viewing positions.

It is another object of the present invention to provide a desk top or suspended multi-positionable document support stand.

It is yet another object of the present invention to provide a support stand and a document holder adapted to be selectively interlocked on the support stand and supported by the stand in multiple positions.

It is a further object of the present invention to provide a support stand and document holder, where the holder includes a mechanism for securing documents, which mechanism may be removed and secured to the support stand.

It is a still further object of the present invention to provide a support stand which is simple in construction and easily manufactured.

It is yet a further object of the present invention to provide a document support stand which secures the document holder to the stand without interfering with the text of the document.

It is still another object of the present invention to provide a document support stand and document holder, each having cooperating interlocking mechanisms for removably mounting the document holder on the support stand.

It is a further object of the present invention to provide a document support stand which overcomes the inherent disadvantages of known support stands.

It is a still further object of the present invention to provide a system of interchangeable document holders and document support devices, each of which includes cooperating interlocking means which allow the free interchange of one holder or support device for another.

In accordance with one aspect of the present invention, the document support stand includes a main body which may be formed in the shape of a truncated pyramid. The body has a viewing side (which is defined by the base side of the truncated pyramid body), and first and second support sides for supporting the stand on a desk or table top, or other support surface. The support sides are transversely disposed to each other and preferably constitute adjacent sides on the truncated pyramid body. Thus, the body may be rotated 90° with either its first or second support side resting on the desk or table top, so that the viewing side may be disposed in different positions.

The main body of the stand includes a mounting device for removably mounting a document holder on the body. The mounting device is secured to the viewing side of the main body.

In a preferred form of the invention, the mounting device is an elongated bracket, C-shaped in cross-section, which defines a T-slot having an exposed open end. The bracket is mounted in a recess formed across the surface of the main body's viewing side.

According to the present invention, a document holder, such as a loose-leaf binder, includes a document mounting device (for example, the binder mechanism), a support for the document mounting device (for example, the jacket, including the front and back covers, on which the binder mechanism is mounted), and an elongated member for mounting the document holder on the support stand.

The elongated member in its preferred form is T-shaped in cross-section and, in the example above of a loose-leaf binder-type document holder, is mounted on the spine of the binder's jacket. The T-shaped member of the holder is slidably received by the C-bracket of the stand through the C-bracket's exposed open end, so that the document holder may be secured to the viewing side of the stand's main body.

Positioned thusly on the stand, the document holder and its documents may be disposed in different positions, for viewing the documents from left to right or top to bottom, by simply rotating the stand 90° so that the stand rests on either of its support sides.

These and other objects, features and advantages of this invention will be apparent from the following detailed description of illustrative embodiments thereof, which is to be read in connection with the accompanying drawings.

BRIEF DESCRIPTIONS OF THE DRAWINGS

FIG. 2 is a rear perspective view of the document support stand and document holder shown in, FIG. 1, with the document support stand partially broken away at portions thereof.

FIG. 4 is a perspective view of a document support stand, constructed in accordance with a second form of the present invention.

FIG. 4A is a front perspective view, partially broken away, of a document support stand, constructed in accordance with a modification to the form of the invention shown in FIG. 4.

FIG. 11 is a perspective view, partially broken away, of a document holder, constructed in accordance with a third form of the present invention.

FIG. 12 is a perspective view of a document holder, constructed in accordance with a fourth form of the present invention.

FIG. 13 is a perspective view, partially broken away, of a document holder, constructed in accordance with a fifth form of the present invention.

DETAILED DESCRIPTION OF THE PREFERRED EMBODIMENTS

Figure 1:
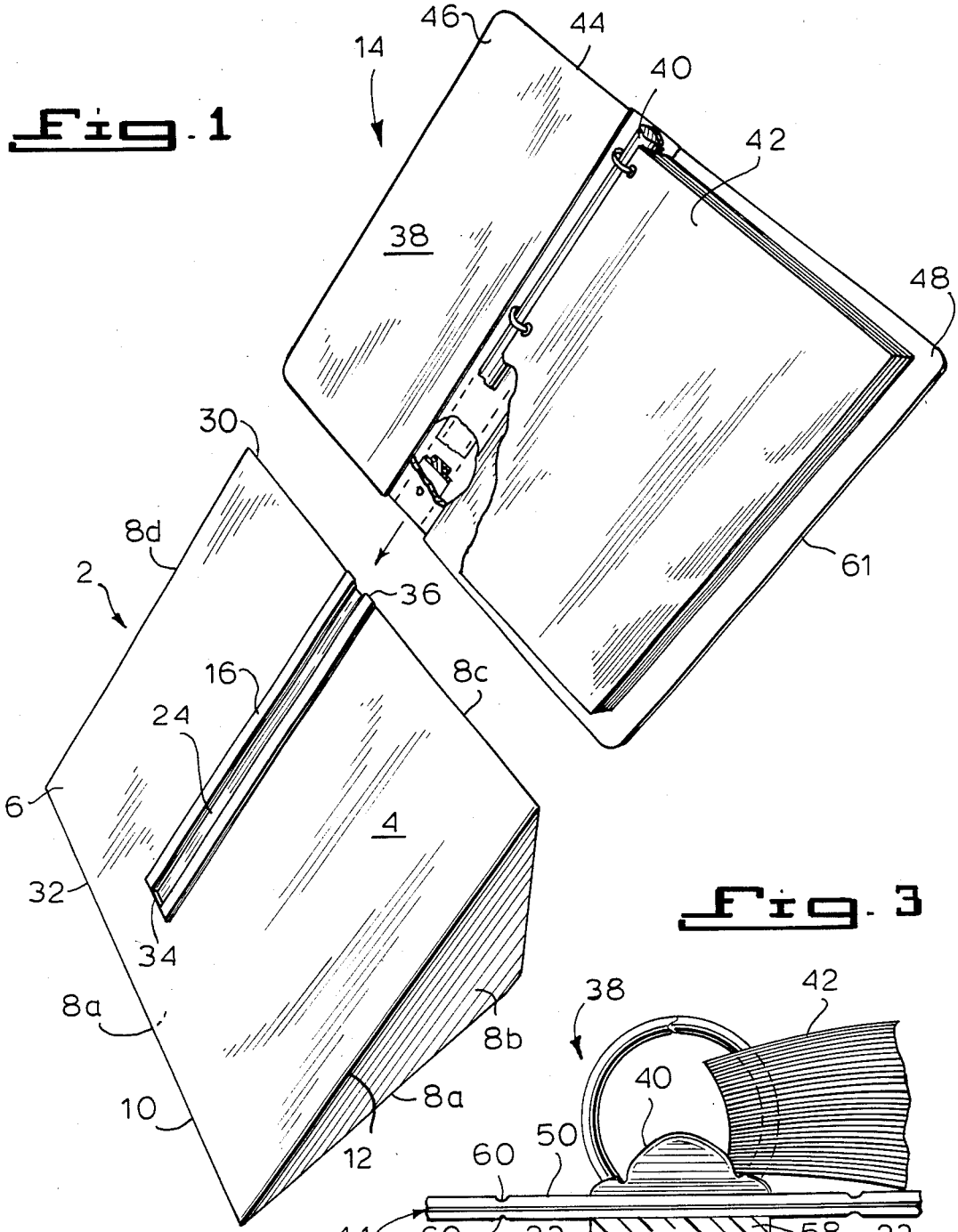
FIG. 1 is a front perspective view of a document support stand and a document holder, constructed in accordance with one form of the present invention.

Initially referring to FIGS. 1 and 2, it will be seen that a document support stand 2, constructed in accordance with one form of the present invention, includes a main body 4 formed in the shape of a truncated pyramid. The body 4 may be of solid construction, for enhanced stability, or formed from a series of joined or integral sides to provide the overall configuration of the truncated pyramid.

In this form of the invention, the main body 4 includes a viewing side 6 (defined by the base of the truncated pyramid construction), and four support sides 8*a*, 8*b*, 8*c*, 8*d* (defined by the truncated pyramid's mutually converging sides). The viewing side 6 is planar in nature, to provide a flat surface for holding and viewing a document mounted thereon, as will be explained. The four support sides 8*a*–are also planar, to provide a stable, flat surface on which the stand may rest when positioned on a desk or table top or other horizontal support surface.

In the embodiment illustrated by FIGS. 1 and 2, only two sides 8*a*, 8*b* are of importance in supporting the stand, although four sides provide greater versatility in positioning the stand on the desk or table top. The two sides 8*a*, 8*b* which are used for support are transversely disposed to each other (each being joined to one of transversely disposed first and second edges 10, 12 of the viewing side), and define adjacent sides of the truncated pyramid body. Refered to hereinafter as the first and second support sides 8*a*, 8*b*, they extend angularly from the viewing side 6 on the same side of the plane in which the viewing side resides.

The viewing side 6 is disposed at a substantial angle to the horizontal in order to minimize eye strain and light reflection. Preferably, the angle A defined by the first support side 8*a* and the viewing side 6 (at the first edge 10), and the angle B defined by the second support side 8*b* and the viewing side 6 (at the second edge 12), are each about 40° to provide the desired angle of viewing. If each angle is selected to be the same, then the 40° slope of the viewing side 6 with respect to the desk or table top will be maintained in all dispositions of the stand, that is, when the stand is resting on any support side 8*a*, 8*b*. However, it may be desirable to form the stand with different angles A and B, for example, 40° and 50° respectively, so that the user may select his preferred viewing angle by merely rotating the stand to rest on a corresponding support side 8*a*, 8*b*.

Sides 8*c* and 8*d* are similarly joined to edges of the viewing side 6, with side 8*c* opposite side 8*a* and side 8*d* opposite side 8*b*, and similarly define angles C and D respectively with the viewing side. It may be desirable to form the body 4 with different angles A and C, for example 40° and 50° respectively, or with different angles B and D, so that the reader may rotate the stand 180° for different viewing angles.

The viewing side 6 is preferably rectangular in shape, and of sufficient dimensions to adequately support a loose-leaf binder or other document holder. The size of the stand, and its viewing side, is selected to fit the needs of the user and the document holders envisioned to be supported.

Figure 3:
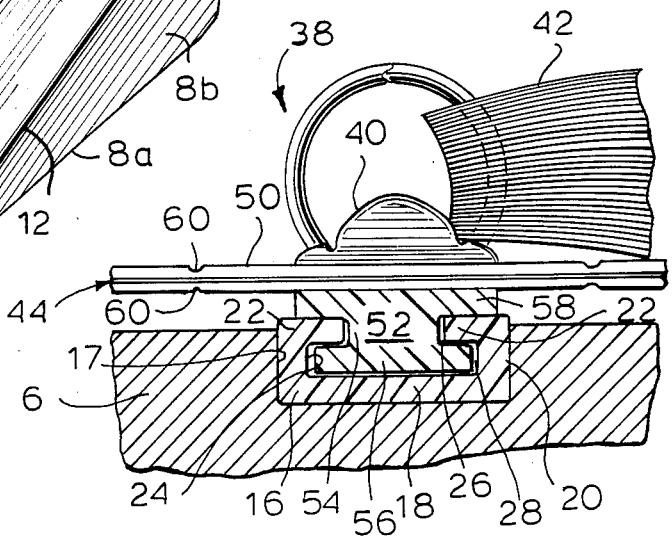
FIG. 3 is a fragmentary top view of the document support stand shown in FIG. 1, with the document holder mounted thereon.

The document support stand 2 further includes a provision for mounting a document holder 14 on the main body 4. In one form of the invention, an elongated bracket 16 having a C-shape in cross-section is mounted in a recess 17 formed in the surface of the viewing side 6 of the body 4. As shown in FIG. 3, the bracket 16 includes a back plate 18, a pair of side plates 20 joined to the back plate 18 on the back plate's opposite transverse edges and extending perpendicularly from the back plate on the same side of the back plate, and a pair of inwardly facing arms 22, each arm 22 being joined to a respective side plate 20 and being spaced apart from the back plate 18.

The C-bracket 16 defines an elongated, T-shaped slot 24, having narrowed and widened portions 26, 28. The narrowed portion 26 of the T-slot 24 is defined between the pair of arms 22, while the widened portion 28 of the T-slot 24 is defined between the back plate 18 and each arm 22.

The bracket 16 is mounted on the main body 4 of the stand 2 with its back plate 18 abutting against the recessed surface of the viewing side 6. Fasteners, glue or other means may be employed to mount the bracket 16 in the recess 17.

The C-bracket 16 mounted in the recessed surface of the viewing side 6 may extend entirely across the viewing side, or may extend from one edge of the viewing side (shown in FIG. 1 as the top edge 30) and terminate before reaching the opposite-edge (for example, the bottom edge 32). The terminated edge 34 of the bracket 16 defined by the end of the recess 17 provides a stop, which limits the extent to which a document holder 14 may be received by the bracket 16. This prevents the document holder 14 from inadvertently slipping out of the bracket slot 24 when mounted on the stand 2, and also lets the user know that the holder is fully and properly mounted on the stand.

As mentioned above, at least one end 36 of the bracket 16 extends to an edge of the viewing side 6. Thus, this end 36 is exposed, and is open to the slot 24 so that a document holder 14 may be slidably received by the slot through the exposed open end 36.

FIG. 3, in association with FIGS. 1 and 2, illustrates one form of a document holder 14 constructed in accordance with the invention, and demonstrates how that document holder is mounted on the document support stand 2.

A conventional loose-leaf binder 38, having a binder mechanism 40 to hold pages or documents 42, and a jacket 44 having a front and back cover 46, 48, with the binder mechanism 40 mounted on the inside surface of the jacket at its spine 50, is modified to further include an elongated rail 52 mounted on the outside surface of the jacket 44 at or near the spine 50. The elongated rail 52 has a T-shape in cross-section with narrowed and widened portions 54, 56 that correspond in dimensions to the widened and narrowed portions 28, 26 of the slot 24 defined by the C-bracket 16. The T-rail 52 may include a back plate 58 spaced from its widened portion 56 for mounting the rail on the loose-leaf binder jacket, such as by gluing, fasteners or other means. Or, the T-rail 52 may be integrally formed with the jacket when the loose-leaf binder is made.

As shown in FIGS. 1 through 3, the loose-leaf binder-type document holder 14 is removably mounted on the document support stand 2 by sliding its T-rail 52 through the exposed end 36 of the C-bracket 16 into the bracket's T-slot 24 until the document holder is centered on the viewing side 6 or abuts the terminated end 34 of the C-bracket.

The C-bracket 16 of the stand 2 securely holds the document holder 14 and supports it at its spine 50. Most loose-leaf binders are adapted to fold about the binder mechanism and the documents held thereby to protect the documents, and are made to flex at fold lines or creases 60 running parallel to the spine 50. The loose-leaf jacket 44 provides poor support when stood on its side edges 61, because it has a tendency to flex at its fold lines. The best support for the loose-leaf binder is thus provided by positioning the T-rail 52 at the spine 50 of the loose-leaf jacket, where the most weight of the loose-leaf binder and where the fold lines 60 are situated.

Thus, the loose-leaf binder 38 may be repositioned by the reader to different viewing dispositions, for instance, for changing a reading pattern of from left to right to top to bottom, without manipulating the document holder on the stand 2, simply by rotating the stand 90° that it rests on a different support side 8*a*, 8*b*.

Figure 3A:
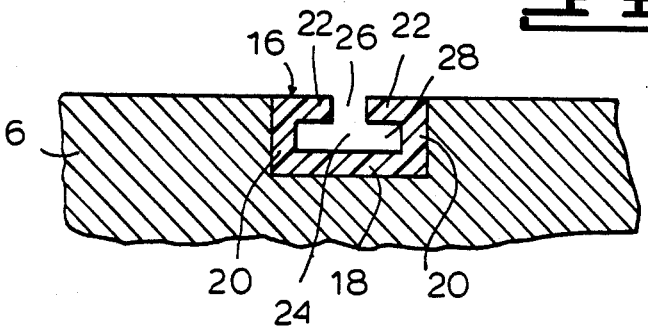
FIG. 3A is a fragmentary sectional view of the document support stand shown in FIG. 1, illustrating one form of the viewing side thereof.

FIGS. 1 through 3 show the C-bracket 16 protruding slightly above the surface of the viewing side 6. It may be desirable to mount the C-bracket 16 flush to the surface of the viewing side 6, as illustrated by FIG. 3A, or slightly deeper in the viewing side 6 to compensate for the thickness of the T-rail's back plate 58, so that the jacket 44 substantially rests on the surface of the viewing side 6 for flat support over more of the loose-leaf jacket's area. However, it is envisioned to be within the scope of this invention, and may also be desirable, to mount the C-bracket 16 directly on the surface of the viewing side, without forming a recess 17 in the viewing side 6, so that a slightly backward bend to the loose-leaf cover is provided which tends to further maintain the loose-leaf binder 38 in an open condition when disposed with its spine 50 horizontal.

Figure 3B:
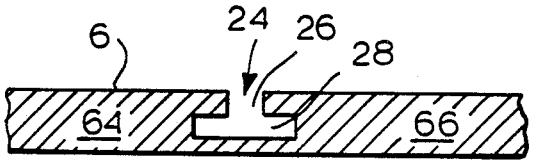
FIG. 3B is a fragmentary sectional view of the document support stand shown in FIG. 1, illustrating another form of the viewing side thereof.

Of course, it is also envisioned to be within the scope of this invention to eliminate a separate C-bracket member 16 and to form the T-slot 24 directly in the surface of the viewing side 6, as illustrated by FIG. 3B. In such a case, the narrowed and widened portions 54, 56 of the T-slot 24 are defined by first and second portions 64, 66 of the viewing side, the first and second portions 64, 66 being L-shaped and in relative mirror image disposition, as illustrated.

FIG. 4 illustrates a second form of a document support stand, constructed in accordance with the present invention. This alternative form of the stand includes a main body 70 formed as a one-piece, plate-like member bent into three non-parallel, planar dispositions to define three integral sides. One side 72 is the viewing side of the stand; the other two sides are first and second support sides 74, 76. Each of the viewing and support sides 72–76 perform a similar function to that performed by the sides of the stand shown in FIGS. 1 through 3, and define similar angles A and B therebetween, as in the first embodiment described.

An elongated slot 78 is formed directly in the viewing side 72 of the plate-like body 70 , and extends from the top edge 80 of the stand and across the viewing side 72, and terminates short of the fold 82, as illustrated by FIG. 4. The thickness of the plate surrounding the slot 78 is substantially equal to the space defined between the back plate 58 and the widened portions 56 of the T-rail 52 of the document holder, as shown in FIG. 3, and the width of the slot 78 conforms to the width of the narrowed portion 54 of the T-rail. Thus, the document holder is slidably mountable on the document support stand, with its T-rail 52 being securely captured within the slot 78 formed in the viewing side of the stand.

It is evident from the above description that the second support side 76 may be eliminated, as illustrated by FIG. 4*a*, the possible sacrifice of some stability to the stand. The modified stand would then be comprised of the viewing side 72 and the first support side 74. The side edges 84, 86 of the viewing side 72 and the first support side 74 constitute the support for the stand when it is rotated 90° from the position shown in FIGS. 4 and 4*a*, so that the stand rests on these edges 84, 86.

As in the other embodiments, the first and second support sides 74, 76 of the stand of FIG. 4 define a 40° angle with the viewing side 72 so that the viewing side is disposed at a substantial angle to the desk or table top to lessen eye strain and fatigue. In the modified stand of FIG. 4*a*, the side edge 86 of the first support side 74 resides in a plane which defines a 40° angle with the viewing side 72.

To increase stability of the edge supported stand shown in FIG. 4*a*, a weight 88 may be added. The weight 88 is mounted on the first support side 74 near its side edge 86. The weight 88 lowers the center of gravity of the stand when it is disposed on its side edge, and minimizes the chance of the stand toppling under the weight of the document holder.

Figure 5:
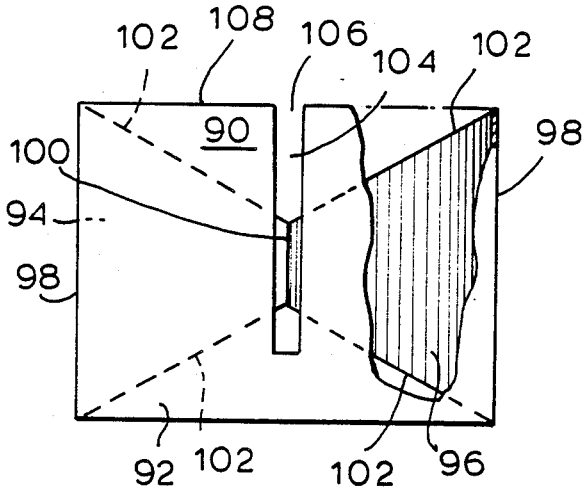
FIG. 5 is a front elevational view, partially broken away, of a document support stand, constructed in accordance with a third form of the present invention.

FIG. 5 shows a third form of the document support stand, and combines the features of the stands shown in FIGS. 1 through 3 and FIGS. 4 and 4A. The stand includes a body 90 having an overall pyramid or truncated pyramid geometric shape, as with the first stand described (FIGS. 1–3), but which is only three sided and edge supported in one of its dispositions, as well as being formed from a bent plate-like member, as in the second embodiment of the stand and its modification (FIGS. 4 and 4A).

The main body 90 of the stand includes a rectangular, planar viewing side 92 (the base of the pyramid configuration), and two planar support sides 94, 96 joined to the opposite edges of the viewing side. Each support side 94, 96 defines with the viewing side 92 an acute angle, preferably about 40°, along the opposite edges 98 of the viewing side. The support sides 94, 96 extend from the viewing side 92 on the same side of the plane in which the viewing side resides, and mutually converge towards the rear of the stand to join each other and define a back edge 100.

Each support side 94, 96 is trapezoidal in shape, and includes exposed side edges 102. These side edges 102 are used to support the stand on a desk or table top, as exemplified by the disposition of the stand shown in FIG. 5. The side edges 102 of the support sides 94, 96 preferably reside in planes which define angles of 40° with the viewing side 92, so that the viewing side 92 is disposed at the same angle with respect to the desk or table top with the stand in any user selectable disposition. Alternatively, as in the embodiment shown in FIGS. 1 through 3, the angles of the support sides 94, 96 and side edges 102, with respect to the viewing side 92, may be selected to provide different viewing angles for different dispositions of the stand.

As in the stand shown in FIGS. 4 and 4A, the stand of FIG. 5 has an elongated slot 104 formed in its viewing side 92, with an open end 106 of the slot disposed at the viewing side's top edge 108. The elongated slot 104 is dimensioned to receive the T-rail 52 of a document holder, such as that of the holder described previously and shown in FIG. 3.

The stand of FIG. 5 can be rotated to rest on either of the support sides 94, 96, or on the exposed edges 102 of the support sides, so that the slot 104 will be either vertically or horizontally disposed. A document holder thus received by the slot and secured to the viewing side 92 of the stand is displayable in different dispositions, to change reading patterns, for instance, for left to right or top to bottom viewing, without manipulating the document holder on the stand, by merely rotating the stand so that it rests on its support sides 94, 96 or the side edges 102 of the support sides.

Figure 6:
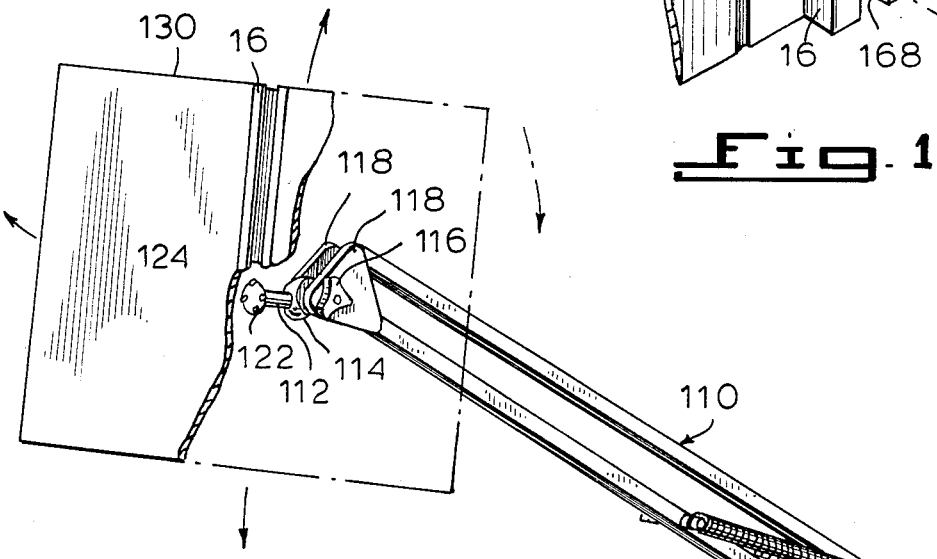
FIG. 6 is a perspective view, partially broken away, of a document support stand, constructed in accordance with a fourth form of the present invention.
Figure 7:
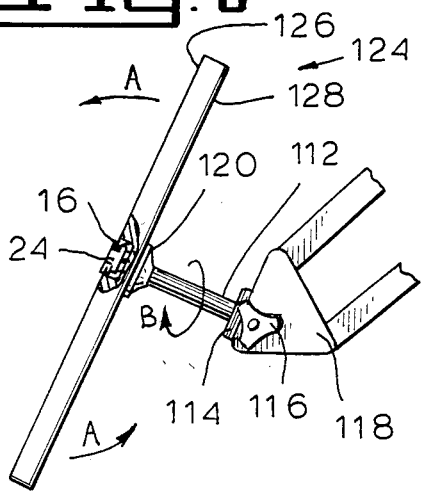
FIG. 7 is a fragmentary side view of the document support stand shown in FIG. 6, with the main body of the stand rotated 90° from the viewing position shown in FIG. 6.

Referring now to FIGS. 6 and 7, a fourth form of a document support stand, constructed in accordance with the present invention, is shown. In this form of the invention, a document holder may be suspended above the workplace and may be adjusted both in the viewing angle and in its rotation.

The document support stand first includes a conventional, double-arm multi-function support bracket 110. Such brackets are typically used for supporting a swing arm type lamp over a desk top, drafting table or the like, and are usually mounted at the edge of the desk or table. Such a support bracket is used on the swing-arm lamp Model No. 173-7500, manufactured by Electrix, Inc.

The support bracket 110 includes a pinion 112 which is rotatably held by a sleeve 114. A knob 116 can adjust the pressure that the sleeve 114 exerts on the pinion 112 and the degree to which the pinion is rotatable.

The sleeve 114 is clamped between two side brackets 118, so that the sleeve, and the pinion 112 held by the sleeve, are angularly adjustable from the vertical. The angular disposition of the pinion 112 selected by the user may be maintained by tightening the knob 116, which increases the side brackets'holding force on the sleeve 114.

The pinion 112 includes a flange 120 mounted on its free end. Holes 122 are formed in the flange 120 for receiving screws or other fasteners for mounting a lamp or other object to the support bracket.

In the present invention, a planar plate-like member 124, rectangular in form, is mounted on the flange 120 of the support bracket 110. The plate-like member 124 includes a front side 126, constituting the viewing side of the document support stand, and an opposite rear side 128, to which the flange 120 of the support bracket is attached.

As in the other previously described embodiments, the document support stand of FIGS. 6 and 7 includes a provision for mounting a document holder to the stand. The same forms of the document holder mounting structure used in the other stands of the invention may be employed here. For example, the C-bracket 16 shown in FIG. 3 may be mounted on the surface of the viewing side 126 of the plate-like member 124, or mounted flush to the surface in a recess formed in the viewing side 126. Alternatively, as exemplified by FIG. 3B, a T-slot 24 may be formed directly in the member and defined by L-shaped member portions 64, 66.

As a further alternative, the member 124 may be a relatively thin plate formed with an elongated slot, as employed in the stands of FIGS. 4 and 4A, with the mounting flange 120 of the support bracket 110 being positioned on the rear side of the member so as not to interfere with the slot.

Depending on the means employed to define the slot 24 in the member, the slot may be open at an edge 80 of the member so that the corresponding T-rail 52 of a document holder, such as that previously described and shown in FIG. 3, may be slidingly received by the slot 24 and secured to the viewing side 126 of the stand.

The document support stand of FIGS. 6 and 7 provides different angles of viewing for the reader by loosening the knob 116 adjusting the member 124 up or down, as illustrated by arrows A in FIG. 7. A document holder secured in the slot 24 on the viewing side 126 of the stand may be rotated to different viewing dispositions (by the pinion 112 turning in the sleeve 114, as indicated by arrow B), for example, the different positions shown in FIGS. 6 and 7, so that the reader may quickly and efficiently adjust his reading pattern, without manipulating the document holder on the stand.

Figure 9:
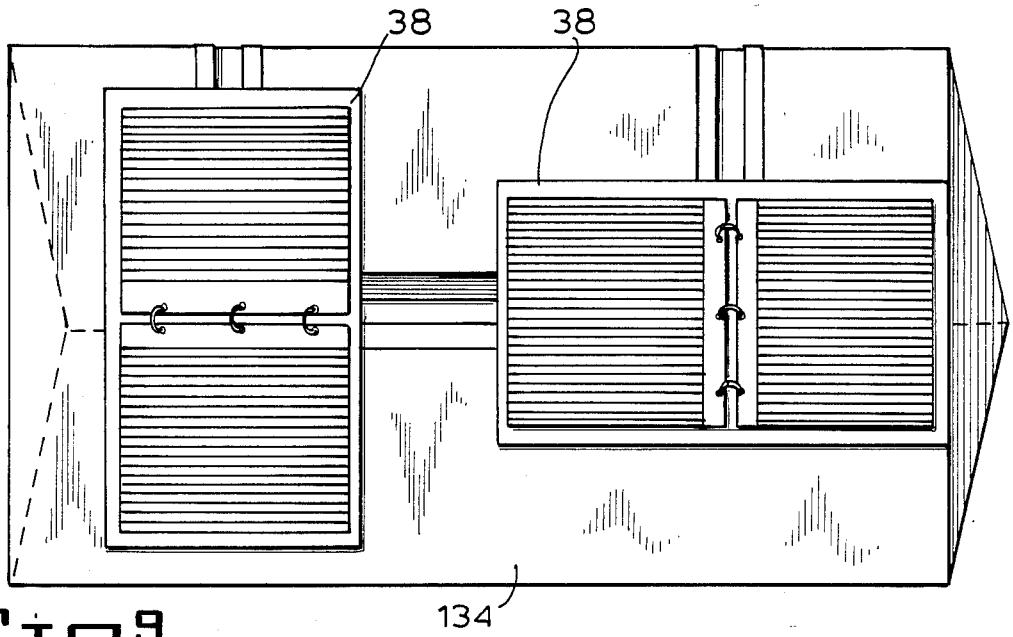
FIG. 9 is a perspective view of the document support stand shown in FIG. 8, with a pair of loose-leaf binders mounted in different dispositions on the stand.
Figure 8:
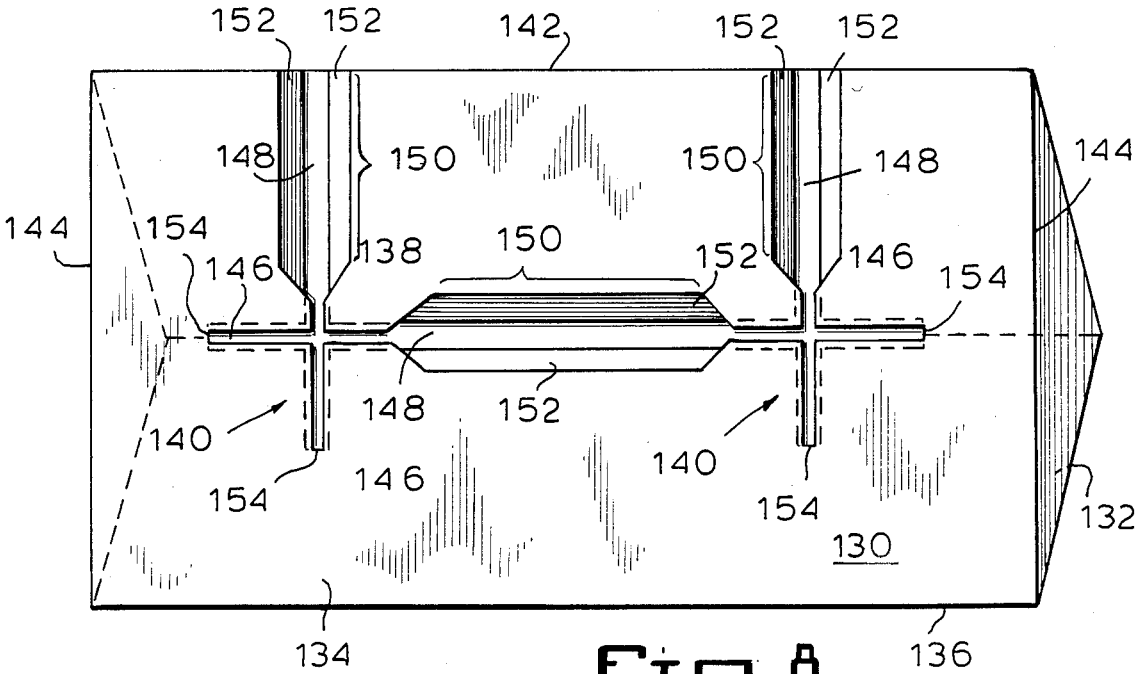
FIG. 8 is a front perspective view of a document support stand, constructed in accordance with a fifth form of the present invention.

Another form of a document support stand is shown in FIGS. 8 and 9. This form of the invention has the capability of securely but removably holding one or more document holders 14 in multiple viewing dispositions on the stand.

The document support stand includes a main body 130 which may be formed as an upstanding wedge-shaped block (i.e., triangular in section). The body 130 has a flat support side 132 which is provided for resting the stand on a desk or table top. It also includes a viewing side 134, disposed at a substantial angle to the desk or table top. The support side 132 and viewing side 134 are joined at a common edge 136, and define between them an acute angle of preferably about 40°.

Other forms of the main body 130 may be employed, rather than the triangular shape shown in FIGS. 8 and 9. For example, a plate-like member (such as that shown in FIGS. 6 and 7), having its front side constituting the viewing side of the stand, and including a support bracket extending angularly from its rear side to the desk top, may be suitably used. Other forms of the main body are envisioned and may be employed, as long as each presents a viewing side for mounting various document holders.

The surface of the viewing side 134 is formed with at least one horizontally disposed T-slot 138, and with at least one vertically disposed T-slot 140, although FIG. 8 shows two vertical slots 140 as the preferred number. The vertical slots 140 extend from the top edge 142 of the stand's viewing side and terminate short of the bottom edge 136. In the preferred form of the stand shown in FIG. 8, the horitontal slot 138 is interposed between the two vertical slots 140 and extends slightly beyond each. The horizontal slot 138 terminates short of two side edges 144 of the viewing side 134, although it may extend to the side edges, in the same fashion as the vertical slots 140 extend to the top edge 142.

The T-slots 138, 140 formed in the surface of the viewing side 134 are substantially the same as the slot 24 defined by the C-bracket 16 shown in FIG. 3, or defined by the viewing sides of the other stands, as shown in FIGS. 3A and 3B. That is, the slots 138, 140 are formed with narrowed portions 146 at the surface of the viewing side 134, and widened portions 148 more recessed from the surface, so that each slot is adapted to receive the complementary shaped T-rail of the document holders.

If both the horizontal and vertical T-slots 138, 140 are formed to extend to the edges of the viewing side 131, their ends are open and exposed so that the document holder's rail may be slid into the open end of the slots.

However, it may be desirable to seat the document holder's rail in either slot 138, 140 by approaching the slot in a direction normal to the viewing side 134 (as opposed to sliding the holder in the slot's exposed end). As shown in FIG. 8, this preferred form of the stand includes portions of the viewing surface which define an enlargement 150 in each slot, which enlargement 150 extends only partially over the length of its respective slot.

The width of the enlargement 150 is equal to or greater than that of the widened portion 56 of the T-rail 52 on the document holder. This enlargement may be in the form of a concave depression defined by inwardly sloping, recessed portions 152 of the viewing side's surface disposed on opposite sides of the slot, which converge into the widened portion 148 of the slot. The concave depression formed in the viewing side is perfectly adapted for receiving a loose-leaf binder with a convex spine.

The document holder 14 may be positioned at the enlargement with its T-rail 52 received by the widened portion 148 of the slot. The holder 14 is then shifted axially along the slot away from the enlargement 150, where its T-rail 52 is held captive by the narrower portion 146 of the slot. The document holder is properly seated on the stand when its T-rail engages the terminated end 154 of the slot.

As illustrated by FIG. 9, a pair of loose-leaf binder-type document holders 38 may be securely held at one time by the document support stand. Thus, the same documents or similar documents may be displayed concurrently, allowing the reader to view the documents in left to right or top to bottom fashion.

It may be desirable to form the document holder with the mechanism that holds the documents being made removable from the cover or protective jacket of the holder. This is especially desirable with modern D-ring loose-leaf binders, which have their binder mechanisms fastened on the inside back cover near the spine, and which include oversized front covers. In many instances, it would be awkward and unnecessary to support such holders in the open condition on the stand, as such loose-leaf binders require an exorbitant amount of space for their oversized jackets.

Figure 10:
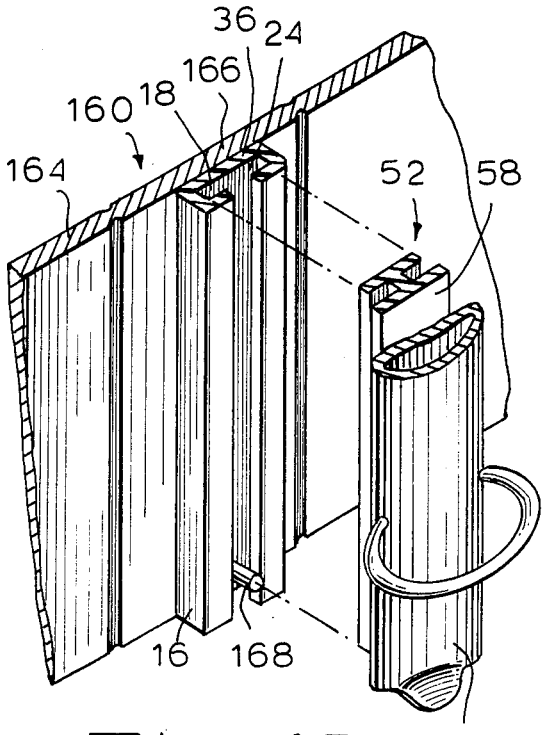
FIG. 10 is a fragmentary perspective view of a loose-leaf binder-type document holder, as an alternative to the form illustrated by FIGS. 2 and 3.

For this reason, a document holder with a document holding mechanism that may be removed and secured to the document support stand may be employed. By way of example, one such document holder, a loose-leaf binder 160, constructed in accordance with the present invention, is shown in FIG. 10.

The loose-leaf binder-type document holder 160 includes a binder mechanism 162, for holding documents, and a protective jacket 164. In the embodiment illustrated, the binder mechanism 162 is positioned at the spine 166 of the jacket 164. However, the same or similar modification would apply to a loose-leaf binder with its mechanism 162 offset from the spine.

A C-shaped bracket 16 having the same structure shown in FIG. 3 and described previously defines a T-slot 24, and is mounted on the jacket 164 with its back plate 18 fastened by glue, fasteners or other means to the inside surface of the jacket 164, and positioned at the spine 166. Alternatively, the bracket 16 may be integrally formed in the jacket 164.

A T-rail 52, having the same structure as that described previously in relation to the other forms of document holders, is mounted on the binder mechanism 162, with its back plate 58 abutting against the mechanism and fastened by glue or other means. The T-rail 52 of the binder mechanism 162 is slidably received by the T-slot 24 of the C-bracket 16 through an exposed open end 36 of the bracket.

The C-bracket 16 may include a pin 168 positioned near one of its ends. The pin 168 projects through the narrowed portion 26 of the slot defined by the bracket, and is provided for limiting axial movement of the T-rail 52 within the slot so that the binder mechanism 162 will not inadvertently slide out of the bottom of the jacket 164 when the two are assembled.

The structure of the document holder described above in relation to FIG. 10 allows the user to remove the binder mechanism 162 holding the documents and secure the mechanism to any one of the document support stands 2 previously described, without the need for mounting the jacket on the stand.

FIGS. 11 through 13 illustrate the versatility of the document support stands and document holders, with their interlocking T-slots and T-rails, and the applicability of the concepts of the present invention to other forms of document holders, constructed in accordance with the present invention.

For example, FIG. 11 shows a clipboard-type document holder, having a board-like backing 170 on which is mounted a clip fastener or a pair of clip fasteners 172. The fasteners 172 are provided to secure a document 174 to the clipboard-type holder.

The holder includes a T-rail 52, such as previously described, mounted on its back. The T-rail 52 interfits with the T-slots 24, 138, 140 formed in the document support stands of the invention so that the clipboard-type holder may be supported by the stands in a variety of positions.

FIG. 12 shows a spiral-bound document holder having a spiral binding mechanism 180 interfitted with a T-rail member 52, as described previously. Like the clipboard-type holder of FIG. 11, the spiral bound document holder may be removably secured to any one of the document support stands previously described.

FIG. 13 shows an L-shaped document holder having an easel back 182 and support ledge 184 joined to the easel back 182. The document holder includes a T-rail 52 mounted on the rear of the easel back 182 so that the L-shaped holder may be mounted on the document support stands described herein.

Because the document support stands and document holders of the present invention employ conforming T-slots and T-rails, the user is provided with the free interexchange of holders and stands, so that he may select any combination of stand and holder to fit his needs.

It is also envisioned that other types of interlocking means may be employed, rather than the T-slot 24 and T-rail 52 of the embodiments described. As such, different species of document support systems may evolve, with non-compatible interlocking means between species. So that document holders of one species may be supported on a document support stand of another species, and vice versa, an adapter plate may be employed.

Figure 14:
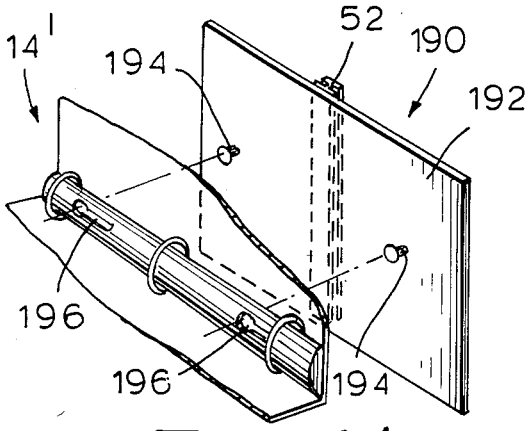
FIG. 14 is a perspective view of an adapter plate, constructed in accordance with the present invention, and a loose-leaf binder, illustrating its attachment to the adapter plate.

An example of such an adapter plate 190 is shown in FIG. 14. The adapter plate 190 includes a flat, plate-like body 192 having front and rear sides. Different forms of inter-locking means are provided on the front and rear sides.

For example, the front side of the body 192 may have stud fasteners 194 with oversized heads mounted to protrude from the surface of the body. The stud fasteners 194 are adapted to be received by keyhole slots 196 formed in the spine or binder mechanism of a loose-leaf type document holder 14'.

A T-rail 52 is mounted on the rear side of the adapter plate 190. The T-rail 52 has the same structure as in the embodiments previously described and conforms to the T-slot 24 formed in the document support stands also previously described.

Thus, the adapter plate 190 may be used to conform the loose-leaf binder holder 14' of one type of document support system to the document support system described herein, with its interlocking T-rail 52 and T-slot 24 configurations.

The document support stands and document holders of the present invention allow the user to support a document holder on a stand he selects and position the document holder in multiple positions for different reading patterns.

The document support stands may be formed from a plastic or other synthetic material, as well as sheet metal or wood. The T-rails 52 and C-brackets 16 may be inexpensively formed of an extruded plastic material.

As is evident from the structures described and shown in the drawings, the document support stands are mechanically simple, with few components, and easily manufactured, and each is adapted to receive and hold a document holder in a number of viewing dispositions.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

I claim:

1. A document support stand for removably mounting a document holder thereon, which comprises:

a main body, the body including a viewing side, a first support side and a second support side, the viewing side having at least first and second edges disposed transversely to each other, the first support side being joined to the viewing side at the first edge thereof, the second support side being joined to the viewing side at the second edge thereof, each of the viewing side and the first and second support sides being substantially planar, the first and second support sides extending angularly from the viewing side on the same side of the plane in which the viewing side resides, the first support side and the viewing side defining therebetween an acute first angle at the first edge, the second support side and the viewing side defining therebetween an acute second angle at the second edge; and means for removably mounting a document holder on the body, the document holder mounting means being situated on the body at the viewing side thereof to allow the document holder to be mounted on the viewing side, the stand being selectively positionable to rest on one of the first support side, thereby supporting a document holder mounted thereon in a first viewing position, and the second support side, thereby supporting a document holder mounted thereon in a second viewing position which is transverse to the first viewing position, the viewing side residing in an x-y coordinate plane which is perpendicular to a z-axis of rotation, the document support stand being adapted to be rotated about the z-axis of rotation so that the viewing side thereof is correspondingly turned within the x-y coordinate plane and adjusted in position within the x-y coordinate plane.

2. A document support stand as defined by claim 1, wherein the main body is formed in a truncated pyramid shape.

3. A document support stand as defined by claim 1, wherein the main body is formed as a one piece, plate-like member bent into three non-parallel planar dispositions to define three integral sides, each side defining one of the viewing side, the first support side and the second support side, wherein the second support side is disposed transversely to the first support side.

4. A document support stand as defined by claim 1, wherein the first angle and the second angle are substantially equal.

5. A document support stand as defined by claim 4, wherein the first and second angles are equal to about 40 degrees.

6. A document support stand as defined by claim 1, wherein the document holder mounting means includes means defining an elongated slot situated on the viewing side of the body, the slot defining means forming the slot with a substantially "T" shape in cross-section, and with a narrowed portion and a widened portion communicating with the narrowed portion.

7. A document support stand as defined by claim 1, wherein the document holder mounting means includes means defining an elongated slot formed in the surface of the viewing side of the body, the slot defining means including first and second portions of the viewing side, the first and second portions residing in the plane of the viewing side and being at least partially separated from each other to define the elongated slot therebetween.

8. A document support stand as defined by claim 1, wherein the document holder mounting means includes means defining an elongated slot formed in the viewing side of the body, the slot defining means forming the slot with a substantially "T" shape in cross-section, and with an outer narrow portion outwardly disposed on the surface of the viewing side, and a widened portion inwardly disposed from the surface of the viewing side.

9. A document support stand as defined by claim 8, wherein the slot defining means includes first and second portions of the viewing side, the first and second portions being L-shaped and in relative mirror image disposition, the L-shaped first and second portions defining therebetween the narrowed and widened portions of the elongated slot.

10. A document support stand as defined by claim 6, wherein the slot defining means includes an elongated member, the member being substantially "C" shaped in cross-section, the member including a back plate, a pair of side plates joined to the back plate on opposite transverse edges thereof and extending perpendicularly from the back plate and on the same side thereof, and a pair of inwardly facing arms, each arm being joined to a respective side plate, the arms being in spaced apart relationship to define therebetween the narrowed portion of the elongated slot, and being spaced apart from the back plate so that the arms and the back plate define there-between the widened portion of the elongated slot, the back plate being mounted on the viewing side of the body.

11. A document support stand as defined by claim 10, wherein the viewing side of the body has formed therein an elongated recess, the recess being dimensioned to receive the elongated member.

12. A document support stand as defined by claim 11, wherein the recess is formed with a depth which substantially equals the overall thickness of the member so that the member is mounted in the recess flush to the surface of the viewing side.

13. An adapter for coupling the document holder to a document support stand, the adapter comprising:

first means for removably mounting a document holder to the adapter;

second means for removably mounting the adapter to the document support stand; and means for supporting the first and second mounting means.

14. A document support stand for removably mounting a document holder thereon, which comprises:

a planar, plate-like body having a front viewing side and a rear side opposite the front side;

means for rotatably supporting the plate-like body and for positioning the body in a selectable angular disposition about a z-axis of rotation, the body being mounted on the body supporting means on the rear side thereof; and means for removably mounting a document holder on the body, the document holder mounting means being situated on the body at the viewing side thereof and substantially at a central portion thereof to allow the document holder to be mounted on the viewing side and to support the document holder at a substantially central portion of the document holder, the document holder mounting means being selectively engageable with the document holder, wherein the body may be rotated on the supporting means to position the viewing side and a document holder mounted thereon in one of a number of selectable viewing positions, the viewing side residing in an x-y coordinate plane which is perpendicular to the z-axis of rotation, the plate-like body being adapted to be rotated about the z-axis of rotation so that the viewing side thereof is correspondingly turned within the x-y coordinate plane and adjusted in position within the x-y coordinate plane.

15. A document support stand as defined by claim 14, wherein the document holder mounting means includes means defining an elongated slot situated on the viewing side of the body, the slot defining means forming the slot with a substantially "T" shape in cross-section, and with a narrowed portion and a widened portion communicating with the narrowed portion.

16. A document support stand as defined by claim 14, wherein the document holder mounting means includes means defining an elongated slot formed on the viewing side of the body, the slot defining means forming the slot with a substantially "T" shape in cross-section, and with an outer narrow portion outwardly disposed on the surface of the viewing side, and a widened portion inwardly disposed from the surface of the viewing side.

17. A document support stand as defined by claim 16, wherein the slot defining means includes first and second portions of the viewing side, the first and second portions being L-shaped and in relative mirror image disposition, the L-shaped first and second portions defining therebetween the narrowed and widened portions of the elongated slot.

18. A document support stand as defined by claim 15, wherein the slot defining means includes an elongated member, the member being "C" shaped in cross-section, the member including a back plate, a pair of sideplates joined to the back plate at opposite transverse edges thereof and extending perpendicularly from the back plate and on the same side thereof, and a pair of inwardly facing arms, each arm being joined to a respective side plate, the arms being in spaced apart relationship to define therebetween the narrowed portion of the elongated slot, and being spaced apart from the back plate so that the arms and the back plate define therebetween the widened portion of the elongated slot, the back plate being mounted on the viewing side of the body.

19. A document support stand as defined by claim 18, wherein the viewing side of the body has formed therein an elongated recess, the recess being dimensioned to receive the elongated member.

20. A document support stand as defined by claim 19, wherein the recess is formed with a depth which substantially equals the overall thickness of the member so that the member is mounted in the recess flush to the surface of the viewing side of the body.

21. In combination:

a document holder, and a document support stand for removably mounting the document holder thereon;

the document support stand including a main body, the main body including a viewing side, a first support side and a second support side, the viewing side having at least first and second edges disposed transversely to each other, the first support side being joined to the viewing side at the first edge thereof, the second support side being joined to the viewing side at the second edge thereof, each of the viewing side and the first and second support sides being substantially planar, the first and second support sides extending angularly from the viewing side on the same side of the plane in which the viewing side resides, the first support side and the viewing side defining therebetween an acute first angle at the first edge, the second support side and the viewing side defining therebetween an acute second angle at the second edge; and means for removably mounting the document holder, the document holder mounting means being situated on the body at the viewing side thereof to allow the document holder to be mounted on the viewing side, the stand being selectively positionable to rest on one of the first support side, thereby supporting a document holder mounted thereon in a first viewing position, and the second support side, thereby supporting a document holder mounted thereon in a second viewing position which is transverse to the first viewing position, the viewing side residing in an x-y coordinate plane which is perpendicular to a z-axis of rotation, the document support stand being adapted to be rotated about the z-axis of rotation so that the viewing side thereof is correspondingly turned within the x-y coordinate plane and adjusted in position within the x-y coordinate plane;

the document holder including means for mounting documents, means for supporting the document mounting means, the document mounting means being mounted thereon, and means mounted on the document mounting support means for engageably cooperating with the document holder mounting means of the document support stand.

22. The combination defined by claim 21, wherein the means for mounting documents of the document holder is a ring-type binder mechanism.

23. The combination defined by claim 22, wherein the means for supporting the document mounting means is an outer protective jacket which is foldable about the binder mechanism, the binder mechanism being mounted substantially near the center of the jacket.

24. The combination defined by claim 21, wherein the means for mounting documents of the document holder is a clip-type fastener.

25. The combination defined by claim 21, wherein the means for supporting the document mounting means includes a planar, plate-like member.

26. In combination:

a document holder, and a document support stand for removably mounting the document holder thereon;

the document support stand including a planar, plate-like body having a front viewing side and a rear side opposite the front side, means for rotatably supporting the plate-like body and for positioning the body in a selectable angular disposition about a z-axis of rotation, the body being mounted on the body supporting means on the rear side thereof, and means for removably mounting the document holder, the document holder mounting means being situated on the body at the viewing side thereof and substantially at a central portion thereof to allow the document holder to be mounted on the viewing side and to support the document holder at a substantially central portion of the document holder, the document holder mounting means being selectively engageable with the document holder, wherein the body may be rotated on the supporting means to position the viewing side and a document holder mounted thereon in one of a number of selectable viewing positions, the viewing side residing in an x-y coordinate plane which is perpendicular to a z-axis of rotation, the plate-like body being adapted to be rotated about the z-axis of rotation so that the viewing side thereof is correspondingly turned within the x-y coordinate plane and adjusted in position within the x-y coordinate plane;

the document holder including means for mounting documents, means for supporting the document mounting means, the document mounting means being mounted thereon, and means mounted on the document mounting support means for engageably cooperating with the document holder mounting means of the document support stand.

27. In combination:

a document holder, and a document support stand removably mounting the document holder thereon;

the document support stand including a main body, the main body including a viewing side, a first support side and a second support side, the viewing side having at least first and second edges disposed transversely to each other, the first support side being joined to the viewing side at the first edge thereof, the second support side being joined to the viewing side at the second edge thereof, each of the viewing side and the first and second support sides being substantially planar, the first and second support sides extending angularly from the viewing side on the same side of the plane in which the viewing side resides, the first support side and the viewing side defining therebetween an acute first angle at the first edge, the second support side and the viewing side defining therebetween an acute second angle at the second edge; and means for removably mounting the document holder, the document holder mounting means being situated on the body at the viewing side thereof to allow the document holder to be mounted on the viewing side, the stand being selectively positionable to rest on one of the first support side, thereby supporting a document holder mounted thereon in a first viewing position, and the second support side, thereby supporting a document holder mounted thereon in a second viewing position which is transverse to the first viewing position, the viewing side residing in an x-y coordinate plance which is perpendicular to a z-axis of rotation, the document support stand being adapted to be rotated about the z-axis of rotation so that the viewing side thereof is correspondingly turned within the x-y coordinate plane and adjusted in position within the x-y coordinate plane;

the document holder including means for mounting documents, means for supporting the document mounting means, and cooperating first and second means for removably mounting the document mounting means to the supporting means, the first means being mounted on the supporting means, the second means being mounted on the document mounting means, the second means being cooperatingly engageable with the document holder mounting means of the document support stand to allow the document mounting means to be removed from the supporting means of the document holder and mounted on the viewing side of the document support stand.

28. In combination:

a document holder, and a document support stand for removably mounting the document holder thereon;

the document support stand including a planar, plate-like body having a front viewing side and a rear side opposite the front side, means for rotatably supporting the plate-like body and for positioning the body in a selectable angular disposition about a z-axis of rotation, the body being mounted on the body supporting means on the rear side thereof, and means for removably mounting the document holder, the document holder mounting means being situated on the body at the viewing side thereof and substantially at a central portion thereof to allow the document holder to be mounted on the viewing side and to support the document holder at a substantially central portion of the document holder, the document holder mounting means being selectively engageable with the document holder, wherein the body may be rotated on the supporting means to position the viewing side and a document holder mounted thereon in one of a number of selectable viewing positions, the viewing side residing in an x-y coordinate plane which is perpendicular to a z-axis of rotation, the plate-like body being adapted to be rotated about the z-axis of rotation so that the viewing side thereof is correspondingly turned within the x-y coordinate plane and adjusted in position within the x-y coordinate plane;

the document holder including means for mounting documents, means for supporting the document mounting means, and cooperating first and second means for removably mounting the document mounting means to the supporting means, the first means being mounted on the supporting means, the second means being mounted on the document mounting means, the second means being cooperatingly engageable with the document holder mounting means of the document support stand to allow the document mounting means to be removed from the supporting means of the document holder and mounted on the viewing side of the document support stand.

29. A document support stand for removably mounting a document holder thereon, which comprises:

a main body, the main body including a viewing side, and first and second support means for supporting the viewing side in at least two viewing disposition which are transverse to each other; and means for removably mounting a document holder on the body, the document holder mounting means being situated on the body at the viewing side thereof to allow the document holder to be mounted on the viewing side, the stand being selectively positionable to rest on one of the first support means, thereby supporting a document holder mounted thereon in a first viewing disposition, and the second support means, thereby supporting a document holder mounted thereon in a second viewing disposition which is transverse to the first viewing disposition, the viewing side residing in an x-y coordinate plane which is perpendicular to a z-axis of rotation, the document support stand being adapted to be rotate about the z-axis of rotation so that the viewing side thereof is correspondingly turned within the x-y coordinate plane and adjusted in position within the x-y coordinate plane.

30. A document support stand as defined by claim 29, wherein the first support means includes a substantially planar support side of the main body, the support side being joined to the viewing side.

31. A document support stand as defined by claim 30, wherein the second support means includes an exposed side edge of the substantially planar support side.

* * * * *

UNITED STATES PATENT AND TRADEMARK OFFICE

CERTIFICATE OF CORRECTION

PATENT NO. : 4,787,595

DATED : November 29, 1988

INVENTOR(S) : David Hegarty

It is certified that error appears in the above-identified patent and that said Letters Patent is hereby corrected as shown below:

Column 5, line 19, "8a-are" should read -- 8a-d are --

Column 8, line 3, insert -- with -- after "4a, "

Column 15, Claim 13, line 1, after "holder" insert -- recited in claim 1 --

Column 17, Claim 27, line 46, insert -- for -- before "removably"

Column 18, Claim 27, line 7, change "plance" to -- plane --

Column 19, Claim 29, line 8, change "disposition" to -- dispositions --

Column 20, Claim 29, line 6, change "rotate" to -- rotated --

Signed and Sealed this

Fourteenth Day of November, 1989

*Attest:*

JEFFREY M. SAMUELS

*Attesting Officer* *Acting Commissioner of Patents and Trademarks*